US005450628A

United States Patent [19]

Lowinger

[11] Patent Number: 5,450,628

[45] Date of Patent: Sep. 19, 1995

[54] REINFORCED GLOVE

[75] Inventor: Daniel J. Lowinger, Cranston, R.I.

[73] Assignee: Acushnet Company, Fairhaven, Mass.

[21] Appl. No.: 297,676

[22] Filed: Aug. 29, 1994

[51] Int. Cl.[6] ..... A41D 13/10; A41D 19/00

[52] U.S. Cl. ..... 2/161.6; 2/159; 2/161.1; 2/164

[58] Field of Search ..... 2/161.2, 159, 161.1, 2/161.5, 164, 163, 16, 19, 165, 166, 275, 161.6

[56] References Cited

U.S. PATENT DOCUMENTS 174,764 3/1876 Blanchard ..... 2/165 X
709,350 9/1902 McMasters ..... 2/165 X
1,358,791 11/1920 Seely ..... 2/159 X
2,012,869 8/1935 Dickson ..... 2/16
2,719,980 10/1955 Haupt et al. ..... 2/159

FOREIGN PATENT DOCUMENTS 620279 6/1961 Italy ..... 2/159

*Primary Examiner*—Clifford D. Crowder
*Assistant Examiner*—Shirra L. Jenkins
*Attorney, Agent, or Firm*—Pennie & Edmonds

[57] ABSTRACT

A glove having a glove body and a thumb casing whose attachment to the golf body is reinforced with a piece sewn at the thumb casing-to-body attachment area and sewn below such attachment area.

8 Claims, 6 Drawing Sheets

REINFORCED GLOVE

BACKGROUND OF THE INVENTION

Prior gloves have included a front body panel to which a thumb case is sewn creating weakening holes. During pulling gloves on the hand and taking them off, the attachment of glove body to the thumb has weakened and sometimes failed. While prior gloves have included thumb-to-body reinforcement, none have properly addressed weaknesses at the thumb and in adjacent areas.

SUMMARY OF THE INVENTION

Broadly, the present invention comprises a configured reinforced piece of material which strengthens part of the attachment between a glove body portion and glove thumb case and at the interior elastic band and at the cuff border. The reinforcement piece in particular increases the strength of stitching at these locations making tearing of glove material from such stitching less likely.

BRIEF DESCRIPTION OF THE INVENTION

DESCRIPTION OF THE PREFERRED EMBODIMENT

Figure 1:
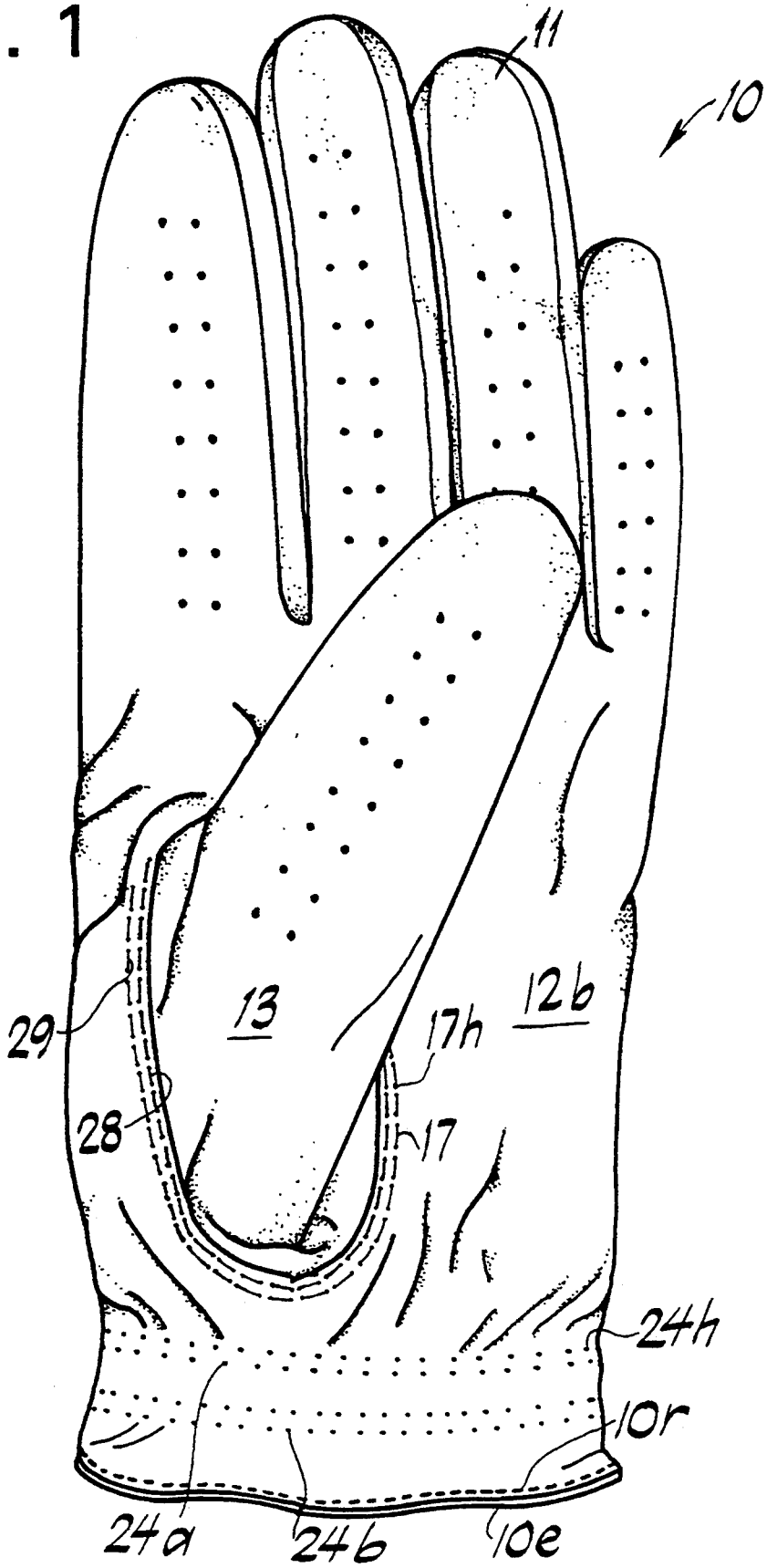
FIG. 1 is a front view of a glove of the present invention.
Figure 2:
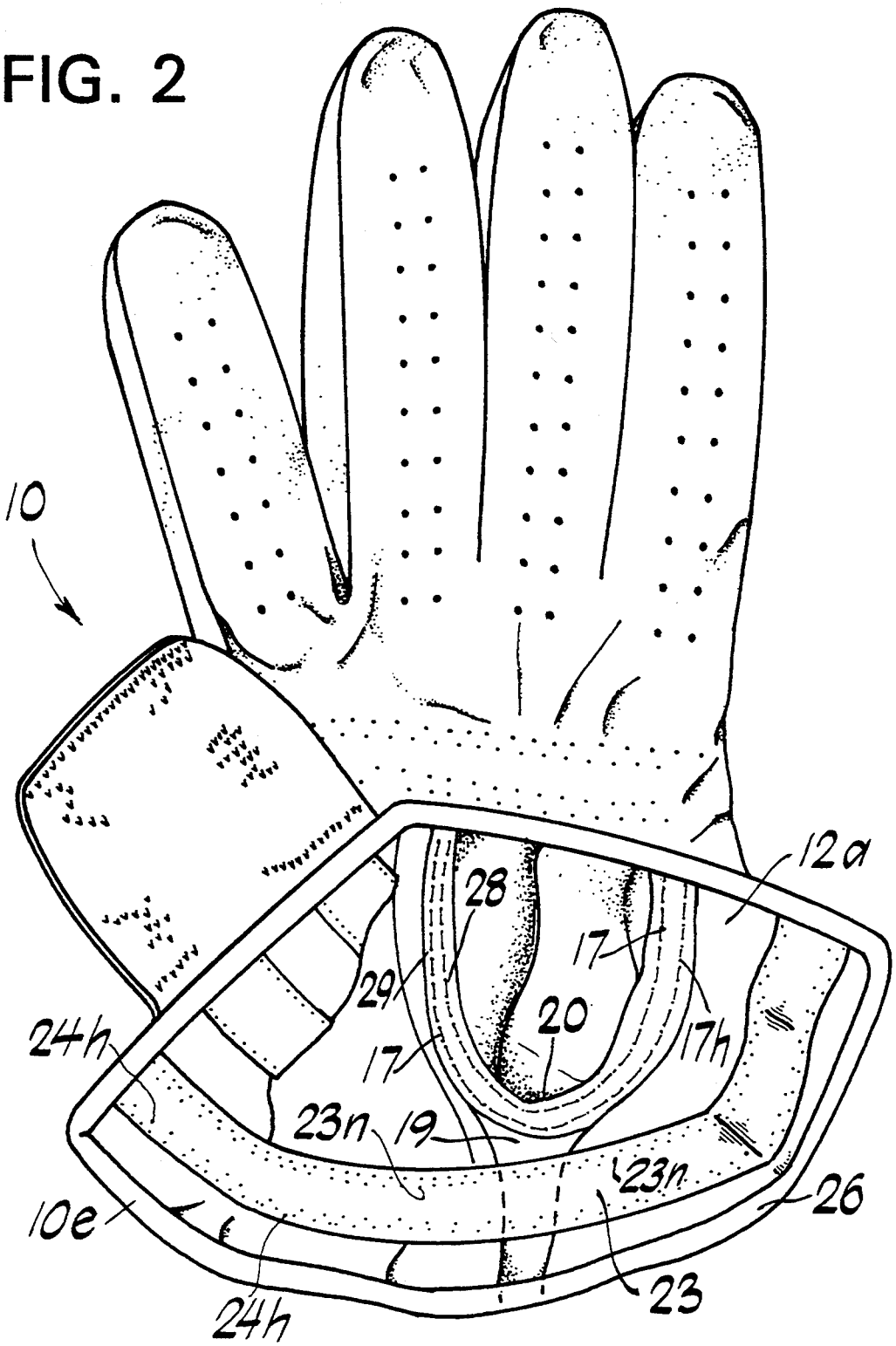
FIG. 2 is a back view of the glove with flap open.

In FIGS. 1–4, a leather skin golf glove 10 has finger casings 11, body 12 with inside body surface **12*a* and outside body surface 12*b*, and thumb casing 13. Thumb casing 13 is stitched to body 12 by two (2) rows of stitching 28, 29. Stitching rows 28, 29 consist of a plurality of individual thread stitches 17 passing through stitch holes 17*h*. Elastic strip 23 is stitched to body 12 using stitch rows 24*a*, 24*b* which stitch rows create holes 24*h*. FIG. 2 shows glove 10 with back opened revealing stitches 17 and reinforcing piece 19 further described below. Glove cuff edge 10*e* includes stitch row 10*r***.

Figure 3:
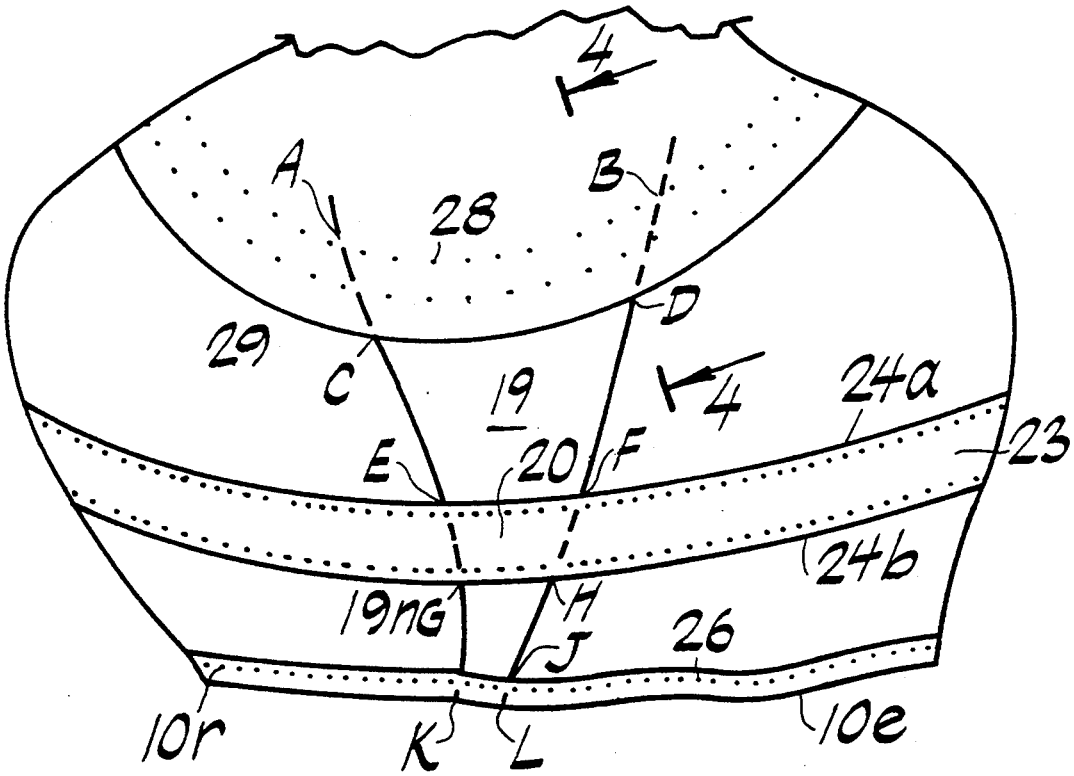
FIG. 3 is a partial enlarged back view of the glove including the lower portion of the thumb case.
Figure 4:
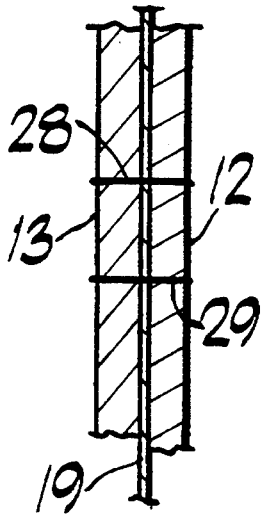
FIG. 4 is a sectional view along line 4—4 of FIG. 3.

Turning in particular to FIGS. 3 and 4, the stitching of body 12 to thumb case 13 is reinforced by reinforcing piece 19 which may be made of nylon, satin, fabric blend or other materials. The joinder of body 12, thumb casing 13 and reinforcing piece 19 creates an edge area having a lower curved edge portion 20 along the lower portion of thumb casing 13. Area 20 is defined by points A–D (see FIG. 3). Weakness is principally located in and around stitch holes **17*h*. Reinforcement piece 19 therefore serves to strengthen the area where stitch rows 28, 29 and stitch holes 17*h* are located. Piece 19 also reinforces areas E–H and I–L and particularly stitching rows therein (see FIG. 3). Since glove 10 is made of leather, reinforcement piece 19 assists in preventing leather fibers from separating and breaking down. Leather has the ability to stretch in varying degrees at different parts of the leather skin. For example, leather skin stretches more from the backbone to the belly when compared with stretch from head to tail. By controlling the stretch, the stress on stitch holes 17*h* is minimized. Reinforcement piece 19 minimizes the stretching, breakdown around holes 17*h* and increases the longevity of glove 10. Reinforcement piece 19** may be made of any material which has little or no break down or stretch even after being stitched by a needle which creates a row of holes in it and subjected to the forces of pulling the glove on and off the hands.

Turning back to FIG. 3, reinforcement piece 19 tapers to narrow neck **19*n* and terminates at the glove cuff edge 10*e*. Piece 19 is positioned under interior wrist elastic strip 23 which strip 23 along with neck 19*n* are sewn to body 12 employing dual stitch rows 24*a*, 24*b* and row 10*r*. Piece neck 19*n* is also positioned under and attached to wrist cuff border strip 26 along glove cuff edge 10*e***.

Figure 5:
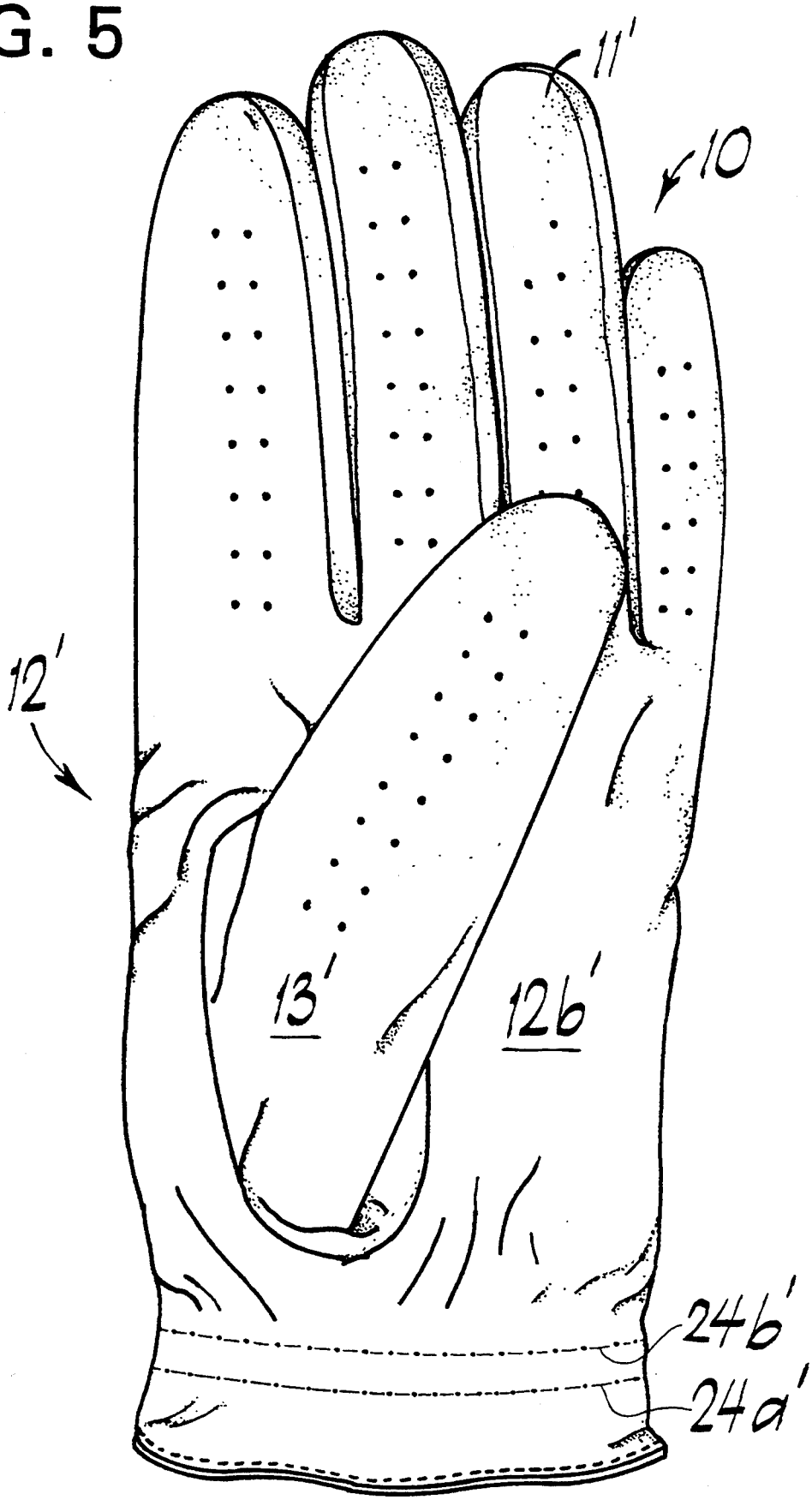
FIG. 5 is a front view of a glove of a second embodiment of the invention.
Figure 6:
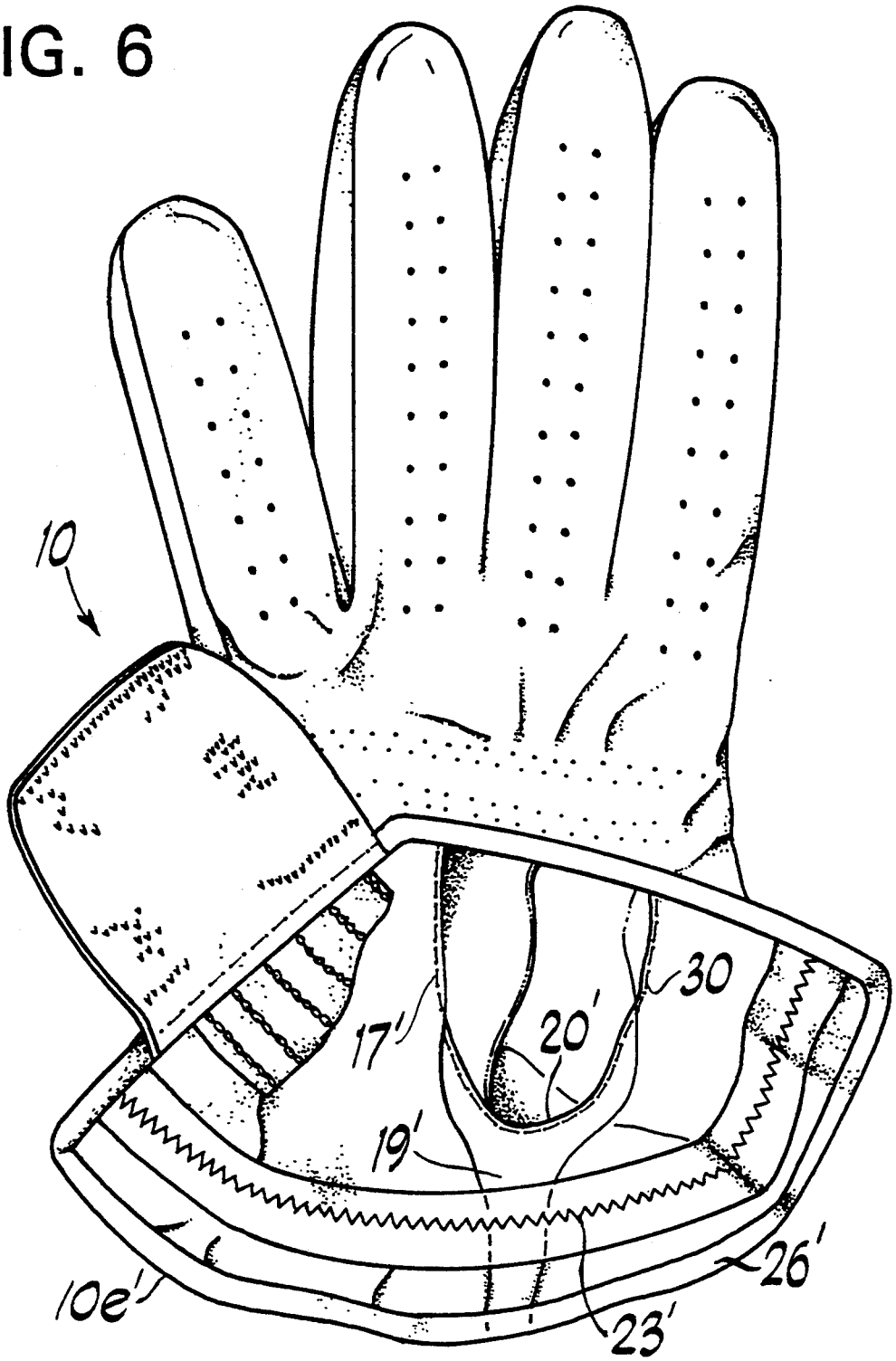
FIG. 6 is a back view of the glove with the flap open.
Figure 7:
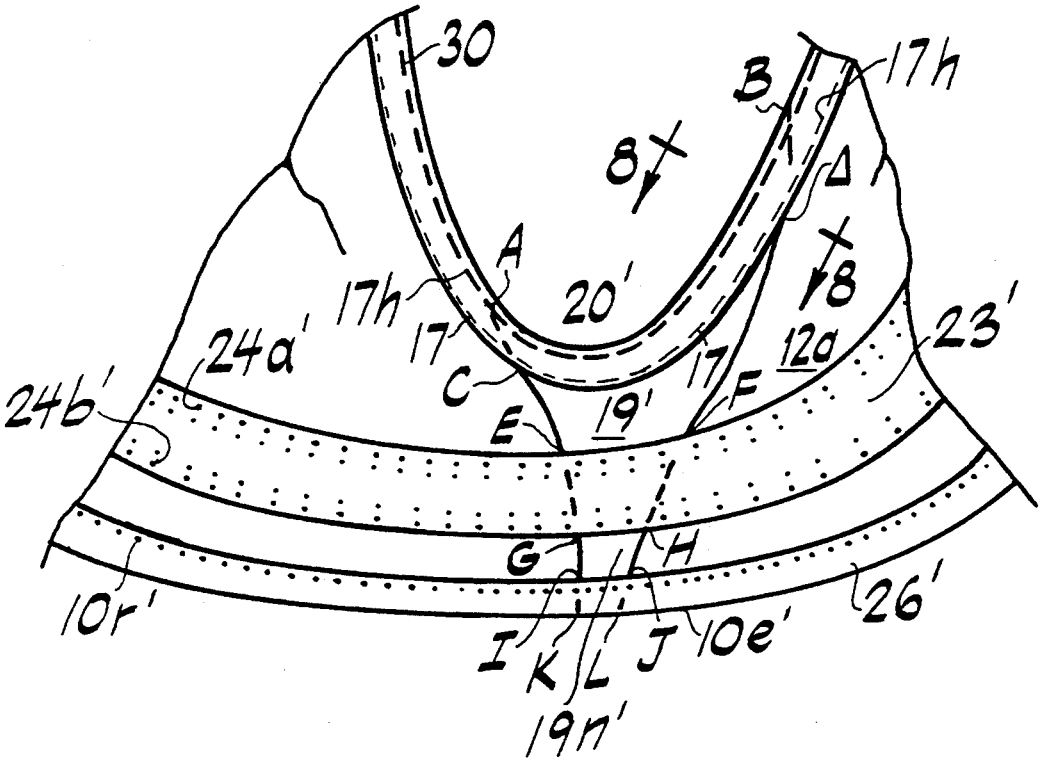
FIG. 7 is an enlarged partial back view of the inner construction of the second embodiment including the lower portion of the thumb case.
Figure 8:
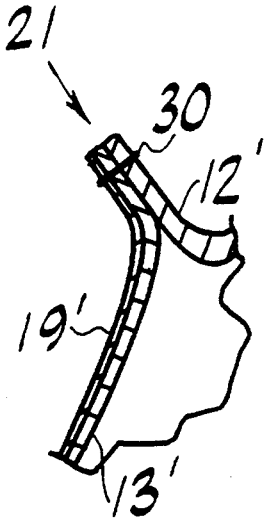
FIG. 8 is a sectional view taken along line 8—8 of FIG. 7.
Figure 1:
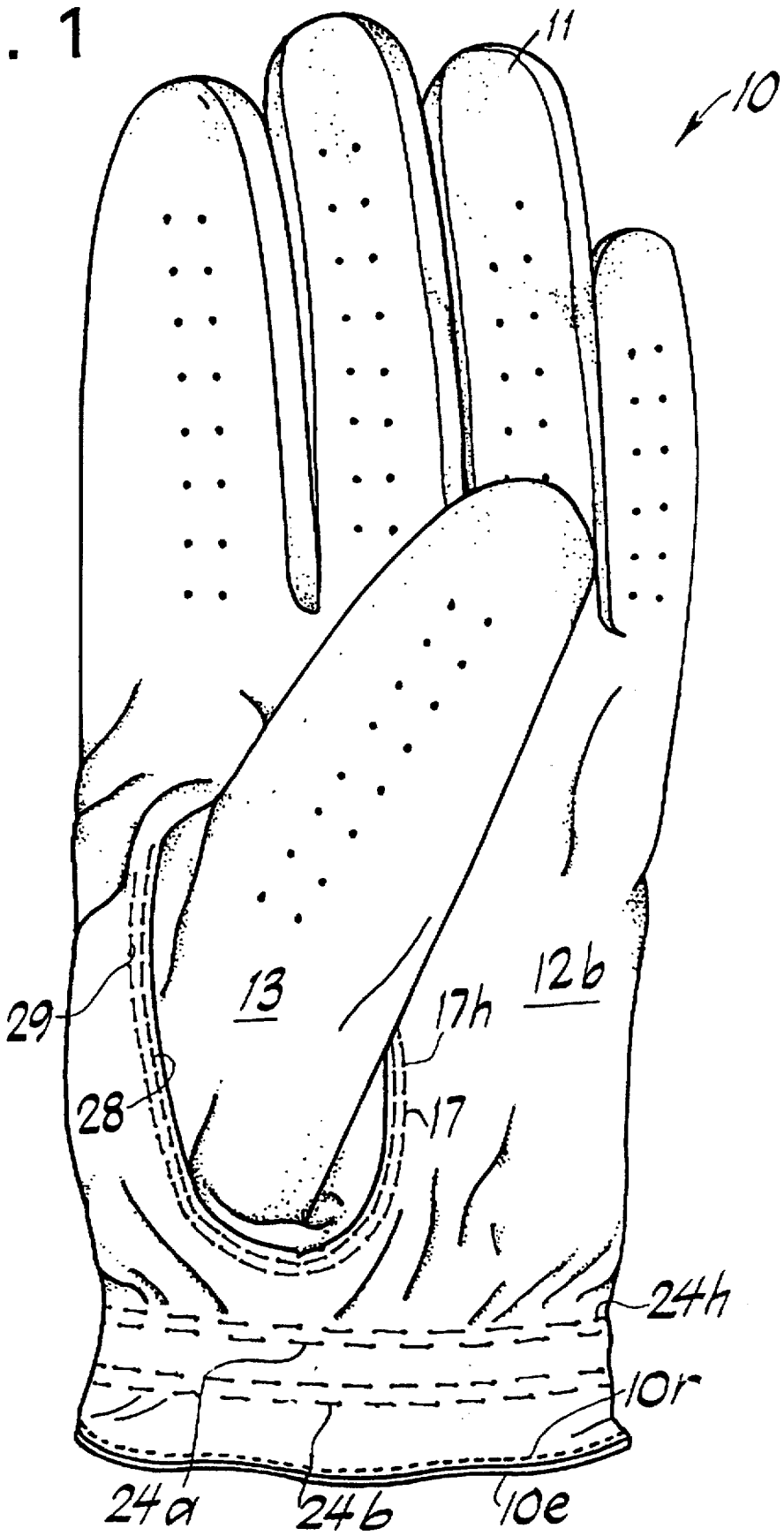
Figure 2:
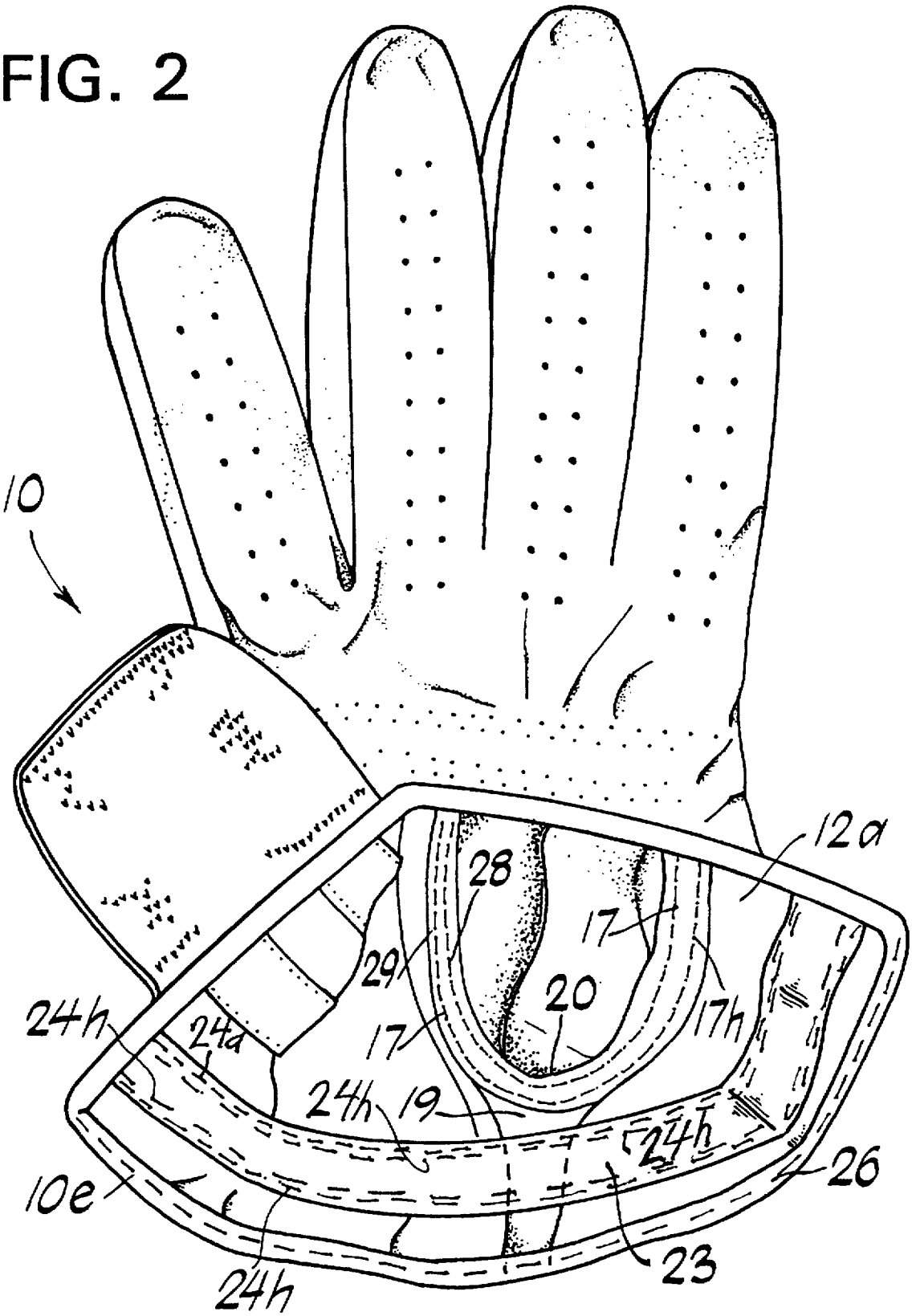
Figure 3:
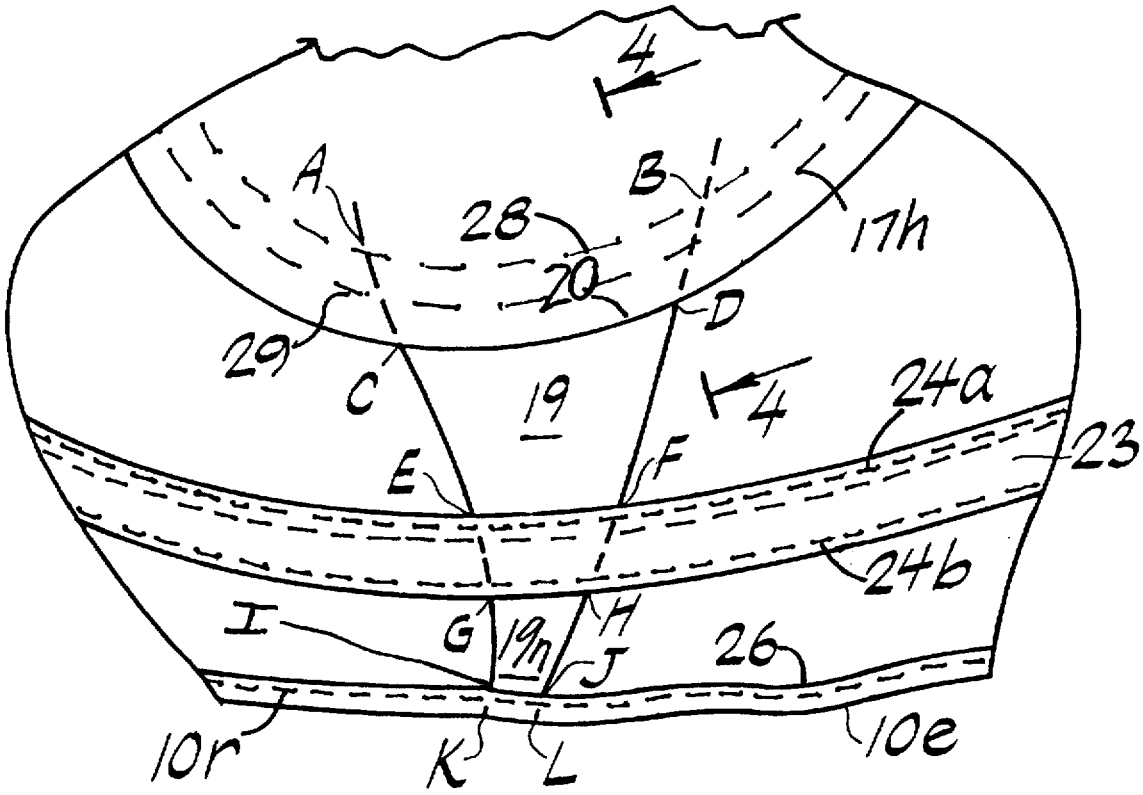
Figure 4:
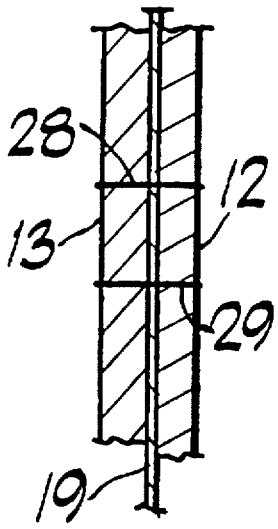
Figure 5:
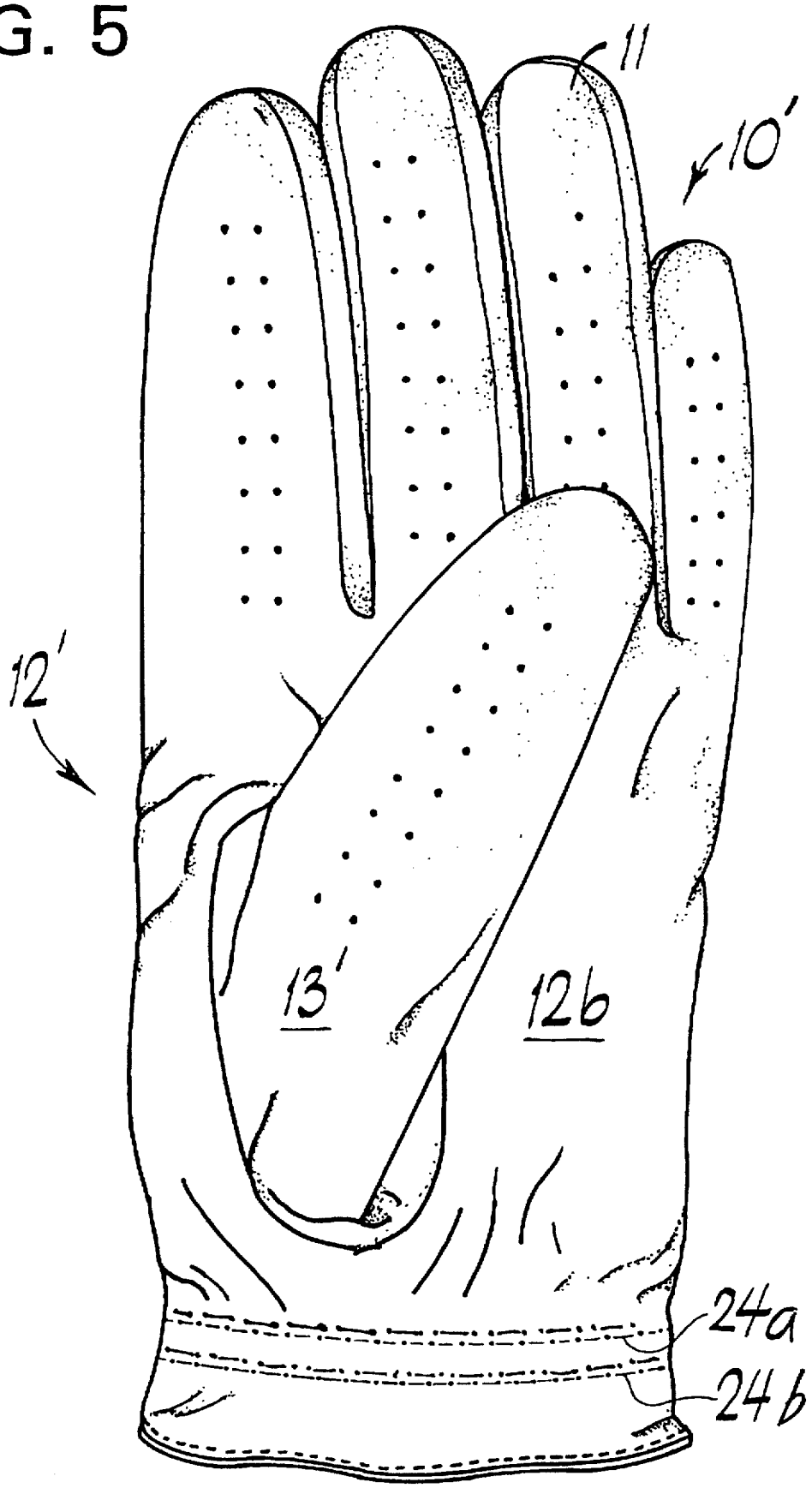
Figure 6:
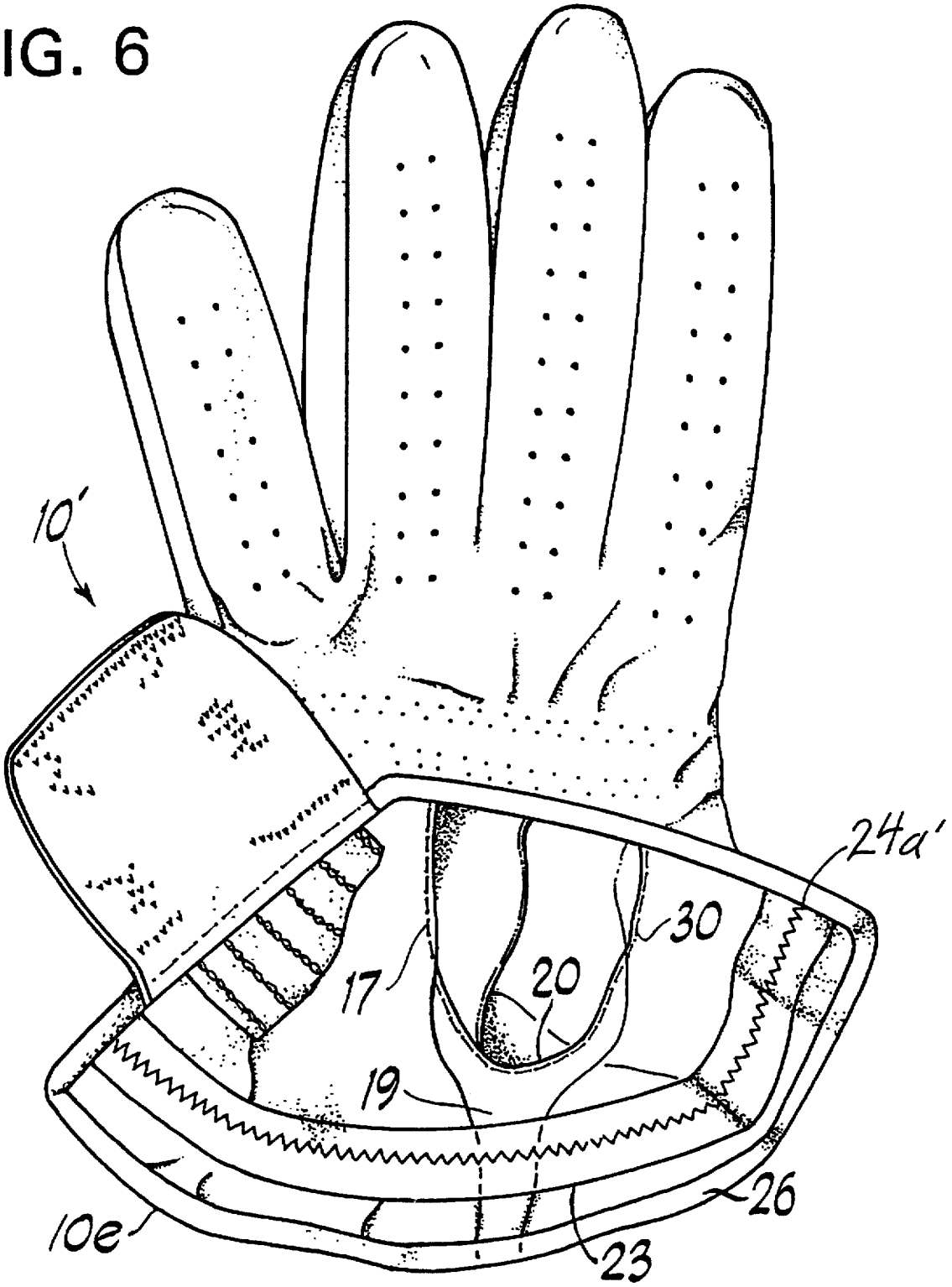
Figure 7:
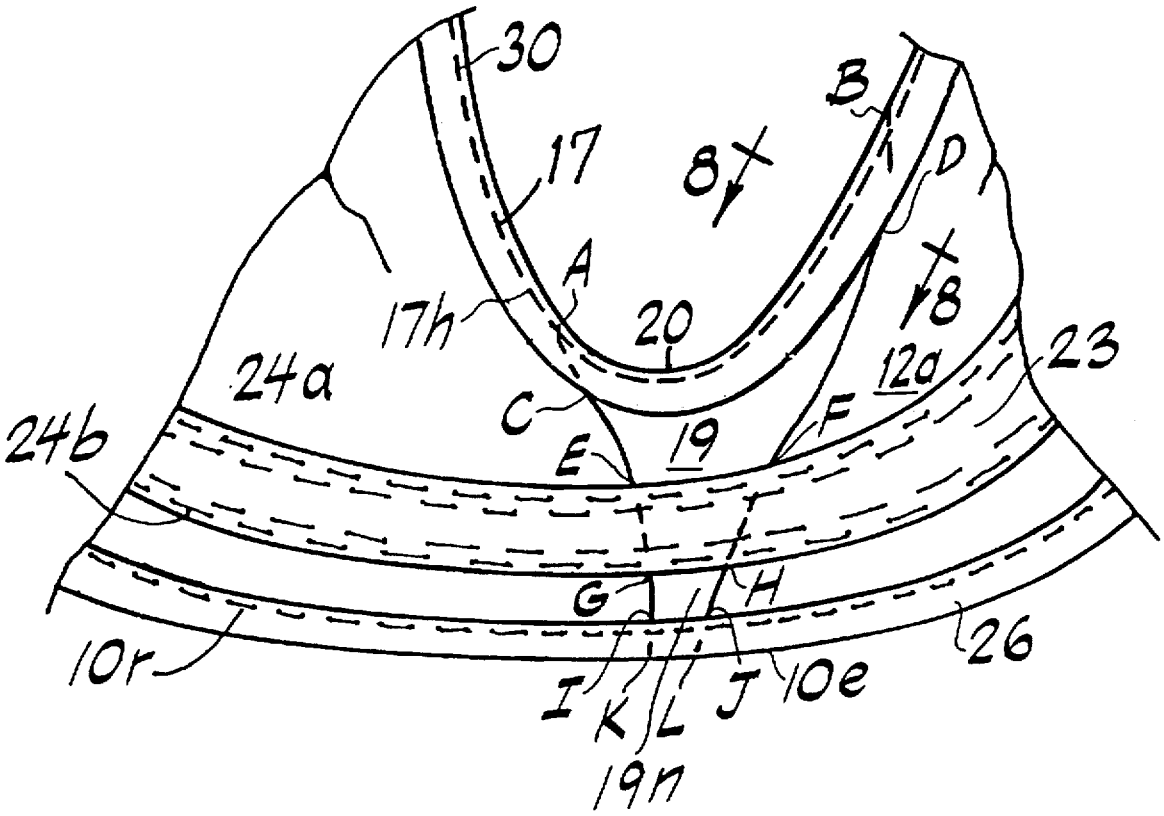
Figure 8:
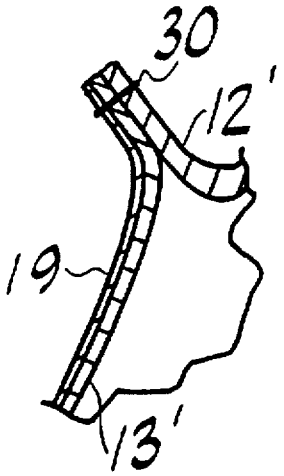

Turning to FIGS. 5–8, the second embodiment of the invention is shown in which glove 10' has thumb case 13' sewn to body 12' in overlapping manner by a single row of stitching 30 which is not visible on the outside of glove 10' (FIG. 5). FIG. 8 shows the layered relationship of piece 19', thumb piece 13' and glove body 12' as held together by stitch 30 prior to folding which makes stitch 30 invisible from the glove exterior (FIG. 5) and visible from the glove interior (FIG. 6). Reinforcing piece 19' is positioned under elastic wrist strip 23' and under border strip 26'. Strip 23' is sewn with stitch rows **24*a*' and 24*b*'. Piece 19' is also secured by stitch row 10*r*' (FIG. 7**).

I claim:

1. In a glove having a body with inside and outside surfaces and a thumb casing in which the body and casing are attached along an edge area having a lower curved portion the improvement comprising a reinforcing piece attached to both the body and casing along the lower curved edge portion of the said edge area positioned within the glove body, and said reinforcing piece attached to a row of stitching below such lower curved edge portion.

2. The glove of claim 1 where the glove is a golf glove.

3. The glove of claim 1 in which the reinforcing piece is positioned in the edge area between body and thumb case and extends below such edge area.

4. The glove of claim 1 in which the reinforcing piece is attached to the thumb case along that portion of the case nearest the glove cuff border.

5. The glove of claim 1 in which the thumb case and body are attached by being stitched together with the stitching visible on the outside surface of the body.

6. The glove of claim 2 in which the glove is made principally of leather.

7. The glove of claim 1 in which the reinforcing piece is made of a material that does not stretch upon being stitched and subjected to the forces of pulling the glove on and off the hand.

8. The glove of claim 7 in which the reinforcing piece is satin.

* * * * *

UNITED STATES PATENT AND TRADEMARK OFFICE

CERTIFICATE OF CORRECTION

PATENT NO. : B1 5,450,628

DATED : June 1, 1999

INVENTORS : Daniel J. LOWINGER

It is certified that errors appear in the above-identified patent and that said Reexamination Certificate is hereby corrected as shown below:

Column 2, line 15, change "23h" to --24h--.

Column 2, line 17, change "deleted" to --moved--.

Column 2, line 17, after "19n" add --, 17h,--..

Column 2, line 17, after "added" insert --, deleted 19n--.

Column 2, line 27, after "24a" insert --, 20,--.

Signed and Sealed this

Thirtieth Day of May, 2000

*Attest:*

*Attesting Officer*

Q. TODD DICKINSON

*Director of Patents and Trademarks*

US005450628B1

REEXAMINATION CERTIFICATE (3774th)

United States Patent [19] [11] B1 5,450,628

Lowinger [45] Certificate Issued Jun. 1, 1999

[54] REINFORCED GLOVE

[75] Inventor: Daniel J. Lowinger, Cranston, R.I.

[73] Assignee: Acushnet Company, Fairhaven, Mass.

Reexamination Request:
No. 90/004,748, Sep. 11, 1997

Reexamination Certificate for:

| | |
|---|---|
| Patent No.: | **5,450,628** |
| Issued: | **Sep. 19, 1995** |
| Appl. No.: | **08/297,676** |
| Filed: | **Aug. 29, 1994** |

[51] Int. Cl.[6] ..... A41D 13/10; A41D 19/00

[52] U.S. Cl. ..... 2/161.6; 2/159; 2/161.1; 2/164

[58] Field of Search ..... 2/161.2, 159, 161.1, 2/161.5, 164, 163, 16, 19, 165, 166, 275, 161.6

[56] References Cited

U.S. PATENT DOCUMENTS

| | | |
|---|---|---|
| Re. 31,538 | 3/1984 | Antonious . |
| D. 308,436 | 6/1990 | Weitzell . |
| D. 314,643 | 2/1991 | Kotowski . |
| D. 371,640 | 7/1996 | Boone . |
| 460,463 | 9/1891 | Conway et al. . |
| 956,156 | 4/1910 | Ornas . |
| 3,251,067 | 5/1966 | Shmikler . |
| 4,027,339 | 6/1977 | Brucker . |
| 4,123,803 | 11/1978 | Rinehart . |
| 4,864,659 | 9/1989 | Morris . |
| 4,987,614 | 1/1991 | Stongwater . |
| 5,004,231 | 4/1991 | Alread . |
| 5,083,314 | 1/1992 | Andujar . |

FOREIGN PATENT DOCUMENTS

| | | |
|---|---|---|
| 230416 | 4/1923 | Canada . |
| 510879 | 3/1955 | Canada . |
| 519307 | 12/1955 | Canada . |
| 1060151 | 8/1979 | Canada . |
| 1277803 | 12/1990 | Canada . |
| 2103218 | 6/1994 | Canada . |
| 51-126724 | 3/1976 | Japan . |
| 54-10048 | 1/1979 | Japan . |
| 5-140804 | 6/1993 | Japan . |
| 6-47123 | 2/1994 | Japan . |

*Primary Examiner*—John J. Calvert

[57] ABSTRACT

A glove having a glove body and a thumb casing whose attachment to the golf body is reinforced with a piece sewn at the thumb casing-to-body attachment area and sewn below such attachment area.

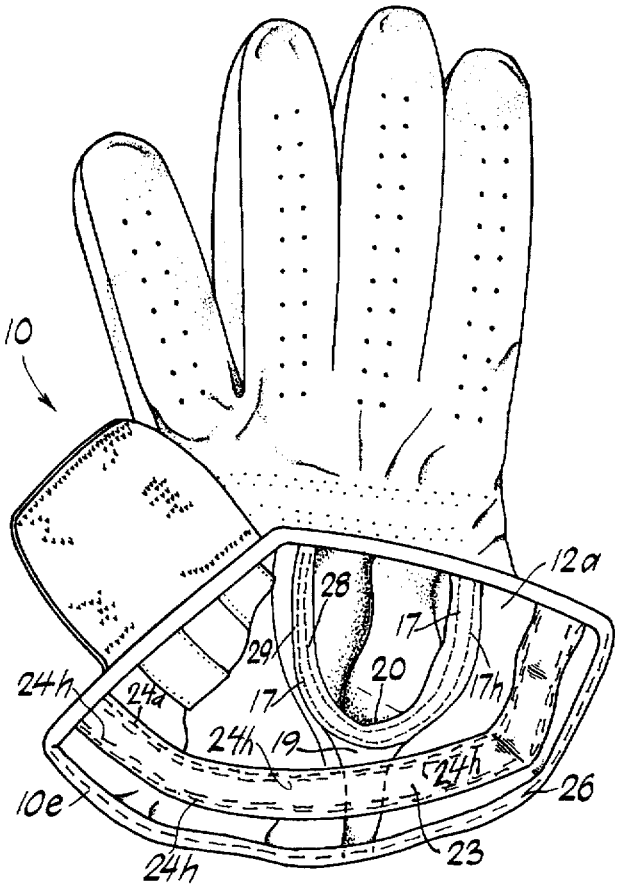

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, lines 42–53:

In FIGS. 1–4, a leather skin glove 10 has finger casings 11, *a front body panel or* body 12 with inside body surface 12a and outside body surface 12b, and thumb casing 13. Thumb casing 13 is stitched to body 12 by two (2) rows of stitches 28, 29. Stitching rows 28, 29 consist of a plurality of individual thread stitches 17 passing through stitch holes 17h. Elastic strip 23 is stitched to body 12 using stitch rows 24a, 24b which stitch rows create holes 24h. FIG. 2 shows glove 10 with back opened revealing stitches 17 and reinforcing piece 19 further described below. Glove cuff edge 10e includes stitch row 10r.

Column 1, lines 54–66:

Turning in particular to FIGS. 3 and 4, the stitching of body 12 to thumb case 13 is reinforced by reinforcing piece 19 which may be made of nylon, satin, fabric blend or other materials. The joinder of body 12, thumb casing 13 and reinforcing piece 19 creates an edge area having a lower curved edge portion 20 along the lower portion of thumb casing 13. Area 20 is defined by points A–D (see FIG. 3). *The points A–D also generally define a first end of the reinforcing piece 19.* Weakness is principally located in and around stitch holes 17h. Reinforcement piece 19 therefore serves to strengthen the area where stitch rows 28, 29 and stitch holes 17h are located. Piece 19 also reinforces areas E–H and I–L and particularly stitching rows therein (see FIG. 3). *The points G–L also generally define an opposite second end of the reinforcing piece 19.* Since glove 10 is made of leather, reinforcement piece 19 assists in preventing leather fibers from separating and breaking down. Leather has the ability to stretch in varying degrees at different parts of the leather skin. For example, leather skin stretches more from the backbone to the belly when compared with stretch from head to tail. By controlling the stretch, the stress on stitch holes 17h is minimized. Reinforcement piece 19 minimizes the stretching, breakdown around holes 17h and increases the longevity of glove 10. Reinforcement piece 19 may be made of any material which has little or no break down or stretch even after being stitched by a needle which creates a row of holes in it and subjected to the forces of pulling the glove on and off the hands.

Column 2, lines 23–35:

Turning to FIGS. 5–8, the second embodiment of the invention is shown in which glove 10' has thumb case 13' sewn to body 12' in overlapping manner by a single row of stitching 30 which is not visible on the outside of glove 10' (FIG. 5). FIG. 8 shows the layered relationship of piece [19'] *19*, thumb piece 13' and glove body 12' as held together by stitch 30 prior to folding which makes stitch 30 invisible from the glove exterior (FIG. 5) and visible from the glove interior (FIG. 6). Reinforcing piece [19'] *19* is positioned under elastic wrist strip [23'] *23* and under border strip [26']. Strip 23'] *26. In FIG. 6, the strip 23 of the second embodiment of the glove 10' shown is attached by a single stitch row 24a'. In FIGS. 5 and 7, strip 23* is sewn with stitch rows [24a'] *24a* and [24b'] *24b*. Piece [19'] *19* is also secured by stitch row [10r'] *10r* (FIG. 7).

THE DRAWING FIGURES HAVE BEEN CHANGED AS FOLLOWS:

Lead lines for 24a, 24b changed & stitching more defined in FIG. 1; stitching more defined, 23n changed to 23h & 24a added in FIG. 2; stitching more defined, lead lines for 28, 24a, 24b, 26 & 10r changed, 20 deleted, 19n & I added in FIG. 3; stitching more defined, 10 changed to 10', 12b' changed to 12b, 11' changed to 11, 24b' changed to 24a, 24a' changed to 24b in FIG. 5; 10 changed to 10', 17' changed to 17, 20' changed to 20, 19' changed to 19, 10e' changed to 10e, 23' changed to 23, 26' changed to 26, 24a' added in FIG. 6; deleted incorrect stitching, stitching add to make more defined, added 17, deleted 17h & 17, changed 24b' to 24b, 24a' to 24a, 10r' to 10r, 20' to 20, 19' to 19, Δ to D, 23' to 23, 19n' to 19n, 10e' to 10e, 26' to 26, changed lead lines for 24b, 24a and 10r in FIG. 7; changed 19' to 19 and deleted 21 in FIG. 8.

AS A RESULT OF REEXAMINATION, IT HAS BEEN DETERMINED THAT:

Claims 1–5 and 7 are determined to be patentable as amended.

Claims 6 and 8, dependent on an amended claim, are determined to be patentable.

New claims 9–16 are added and determined to be patentable.

1. In a glove having a body with inside and outside surfaces and a thumb casing in which the body and *thumb* casing are attached along an edge area having a lower curved *edge* portion, the improvement comprising a reinforcing piece *positioned within the body, said reinforcing piece being* attached *only* to both the body and *thumb* casing along the lower curved edge portion of the [said] edge area [positioned within the glove body] *and to the body below the lower curved edge portion*, and said reinforcing piece *also being* attached to a row of stitching below [such] *the* lower curved edge portion.

2. The glove of claim 1 where the glove is a golf glove, *and the body further includes a front body panel having the thumb casing attached thereto, and the front body panel extends continuously from the thumb casing across the width of the front body panel.*

3. The glove of claim 1 in which the reinforcing piece is positioned in the edge area between *the* body and thumb [case] *casing* and extends *only* below [such] *the* edge area.

4. The glove of claim 1 [in which] *further including a glove cuff edge below the thumb casing, and* the reinforcing piece is attached *only* to [the] *both the body and* thumb [case] *casing* along that portion of the [case] *thumb casing* nearest the glove cuff [border] *edge*.

5. The glove of claim 1 in which [the] *the reinforcing piece is attached only to both the body and* thumb [case and body are attached] *casing* by being stitched together with the stitching visible on the outside surface of the body.

7. The glove of claim 1 in which the reinforcing piece is made of a material that does not stretch upon being stitched and subjected to the forces of pulling the glove on and off [the] *a* hand.

*9. The glove of claim 1, wherein the body further includes a front body panel having the thumb casing attached thereto, and the front body panel extends continuously from the thumb casing across the width of the front body panel, the reinforcing piece further includes a first end and an opposite second end, the first end being attached to both the body and thumb casing along the lower curved edge portion of the edge area, the second end being attached to the body below the lower curved edge portion of the edge area, and the reinforcing piece tapers to a narrow neck with the second end being narrower than the first end.*

*10. The glove of claim 1, wherein the body further includes a front body panel having the thumb casing attached thereto, and the front body panel extends continuously from the thumb casing across the width of the front body panel, and the inside surface of the body further includes an elastic wrist strip and a glove cuff edge below the thumb casing, the reinforcing piece is positioned under the elastic wrist strip, and the reinforcing piece and the elastic wrist strip are attached to the body between the thumb casing and the glove cuff edge by stitches across the body.*

*11. The glove of claim 10, further including a cuff border strip along the glove cuff edge and said reinforcing piece and the cuff border strip are attached to the body by stitches across the body.*

*12. In a glove having a body with inside and outside surfaces and a thumb casing in which the body and thumb casing are attached along an edge area having a lower curved edge portion, the improvement comprising a reinforcing piece positioned within the body, said reinforcing piece being attached to both the body and thumb casing along the lower curved edge portion of the edge area, said reinforcing piece also being attached to a row of stitching below the lower curved edge portion, and the reinforcing piece is made of a material that does not stretch upon being stitched and subjected to the forces of pulling the glove on and off a hand.*

*13. In a glove having a body with inside and outside surfaces and a thumb casing in which the body and the thumb casing are attached along an edge area having a lower curved edge portion, the improvement comprising a reinforcing piece positioned within the body, said reinforcing piece having a first end and an opposite second end, the first end being attached only to the body and the thumb casing along the lower curved edge portion of the edge area, and the second end being attached only to the body below the lower curved edge portion, said reinforcing piece also being attached to a row of stitching below the lower curved edge portion, and said reinforcing piece is made of a material that does not stretch upon being stitched to said body and thumb casing and subjected to the forces of pulling the glove on and off a hand.*

*14. The glove of claim 13, wherein said first end of said reinforcing piece is attached only to both the body and the thumb casing by stitching extending along the lower curved edge portion of the edge area, and said second end of said reinforcing piece is attached only to the body by stitching below the lower curved edge portion.*

*15. The glove of claim 13, wherein said reinforcing piece is narrower at said second end than at said first end.*

*16. The glove of claim 13, wherein the reinforcing piece is made of a material selected from the group consisting of nylon, satin, and a fabric blend.*

* * * * *